US005967700A

United States Patent [19]

Gunther

[11] Patent Number: 5,967,700

[45] **Date of Patent: *Oct. 19, 1999**

[54] LIME/CEMENT COLUMNAR STABILIZATION OF SOILS

[76] Inventor: Johan M. Gunther, 420 Georgina Ave., Santa Monica, Calif. 90402

[ * ] Notice: Under 35 U.S.C. 154(b), the term of this patent shall be extended for 553 days.

[21] Appl. No.: 08/566,681

[22] Filed: Dec. 4, 1995

[51] Int. Cl.[6] ..... E02D 5/46; E02D 3/12

[52] U.S. Cl. ..... 405/233; 405/263; 405/226; 405/269

[58] Field of Search ..... 405/233, 266, 405/269, 263, 264, 267, 258

[56] References Cited

U.S. PATENT DOCUMENTS

| | | | |
|---|---|---|---|
| 3,802,203 | 4/1974 | Ichise et al. | 405/264 |
| 4,606,675 | 8/1986 | Mitani et al. | 405/269 X |
| 4,659,259 | 4/1987 | Reed et al. | 405/269 X |
| 4,747,878 | 5/1988 | Babcock et al. | 405/266 X |
| 5,013,185 | 5/1991 | Taki | 405/266 X |
| 5,108,790 | 4/1992 | Babcock | 405/266 X |
| 5,217,327 | 6/1993 | Nakanishi | 405/266 X |
| 5,304,016 | 4/1994 | Kunito | 405/266 X |

*Primary Examiner*—Dennis L. Taylor
*Attorney, Agent, or Firm*—Donald D. Mon

[57] ABSTRACT

A method to provide a stoichiometric mixture of water, lime and cement for making an in-site piling. Water to supplement existing ground water is supplied by an augur as it drills into the ground so that a substantially uniform concentration of water exists for the full depth. Then the augur, while turning, returns to the surface while it injects and stirs into the wet soil the stoichiometric amounts of lime and cement.

3 Claims, 3 Drawing Sheets

LIME/CEMENT COLUMNAR STABILIZATION OF SOILS

FIELD OF THE INVENTION

Stabilization of soil by preparing in-situ columns (pilings) of the cured reaction between existing water, injected water, lime and cement mixed into the soil, and especially to equipment and process to inject water into the soil in amounts which when combined with water already in the soil will result in a stoichiometric mixture of total water, and the supplied lime and cement.

BACKGROUND OF THE INVENTION

The stabilization of soils in order to accommodate roadways and light structures is of worldwide importance, and numerous techniques are used to provide a suitable soil base. When excessive water is the problem and a suitable gradient is available, drains and wells are commonly used.

However, many areas cannot be serviced suitably by mere drainage means, and even if they are, localized conditions including slope, contour, and soil permeability, often forestall such a straight-forward arrangement. This is especially the situation in areas where the water table is quite close to the surface.

Such a large and pervasive problem has occasioned a large number of proposals to stabilize such soils. One of the most prominent and promising processes is the lime/cement column technique, on which this invention is an improvement. It has been widely used in Scandinavia with considerable success.

In this process, an augur is rotated as it is pressed into the soil. The term "augur" as used herein is not intended in the sense of a drill or other tool which removes material from a bore and leaves an open shaft or hole. Removal of material is not done in this process. Instead, the augur is intended to loosen the soil as it enters the structure, and, as it withdrawn, still rotating, it injects lime and cement into the soil, either dry or as a slurry, stirring this total mixture as it rises to the surface. Thereafter the material sets up as a solid column, and as such stabilizes the soil structure.

For its major applications this is not a small scale operation. The machinery used for practical application is very large and very powerful. Depths of in-situ pilings up to 60 feet, with diameters up to 4 feet are regularly accommodated. It is a rapid process, usually taking less than five minutes to form a 60 foot deep in-situ piling.

A logical process, and one which has been extensively used, is to inject a slurry of water, lime and cement into the soil while the augur is being withdrawn. A major problem with this system is that a large mixing device must accompany the augur. It requires water, lime and cement, and must be cleaned at least daily. It is a large and undesirable appendage. And then, what if the soil is already quite wet.? In such event a slurry injected into a very wet soil might not set up appropriately, having an unsuitable stoichiometric ratio when mixed with water already present in the soil. Accordingly, a process which injects a slurry into the soil involves extra equipment and is limited in its applicability.

Then suppose that dry lime and cement are infected into the soil, rather than as part of a slurry. Then there may not be sufficient water to react with the lime and cement. While such an arrangement would dispense with the slurry operation, it would not necessarily provide a proper mixture for the entire depth of the in-situ piling.

Accordingly, it is an object of this invention for the augur to provide water to the soil in a proper amount when combined with water already present as the augur is pressed into the structure. Thereafter as the augur is removed, it supplies dry lime and dry cement to the soil to provide a stoichiometric mix which will set up to form a useful in-situ piling.

With this process, water in an appropriate amount is injected into the soil separately from the lime and cement. The water is injected and stirred into the soil on the way down, and the lime and cement are infected and stirred into the soil/water mixture on the way up. There need be no slurry unit, and there is no need for cleanup. The water, lime, and cement are kept dry and separate from water until they are injected.

BRIEF DESCRIPTION OF THE INVENTION

This invention utilizes apparatus for injecting into soil such water, lime and cement as are required for this mixture to set up in-situ as a cementitious piling for the purpose of stabilizing surrounding soil with near-stoichiometric ratios of the reactants. The apparatus includes an augur which is powered for rotation, for downward movement into the soil, and for reverse upward movement, all while rotating. The augur is provided with means to inject water into the soil in amounts respective to the already-existing moisture. The augur is also provided with means to inject lime and cement into the already stirred mixture of water and soil, stirring the four components together as the augur leaves the structure, thereby leaving behind it a cylindrical column of mixed material which will soon set up as an in-situ piling with substantially uniform composition and structural properties over its entire length (depth).

According to a feature of this invention, the augur comprises a frame with a pair of blades, and an open space above and inside it, whereby the frame bores into and stirs the soil into which it is pressed, said frame further including separate means for injecting water into the soil, and for infecting lime and cement into the soil.

Means is provided to inject the water, lime and cement at appropriate depths. The water content of the soil at the various depths will have been learned from a previous test boring. It is possible, but generally unnecessary to provide a different schedule for addition of water from one piling location to another, because the properties of the soil will usually be reasonably consistent over a substantial area.

The process of this invention comprises with a rotary augur, the penetration of the augur to a predetermined length. During this penetration, water is added according to a pre-determined schedule, so that the total water in the stirred material is reasonably consistent along the entire depth. Then, while the augur is withdrawn, still rotating, lime and cement are added in amounts such that the total water, lime, and cement are in a substantially stoichiometric relationship when mixed together by the augur as it is withdrawn.

According to a preferred but optional feature of the invention, the augur mounts water nozzles on the edges of the blades which lead while the angur bores into the ground.

The above and other features of the invention will be fully understood from the following detailed description and the accompanying drawings, in which:

DETAILED DESCRIPTION OF THE INVENTION

Figure 1:
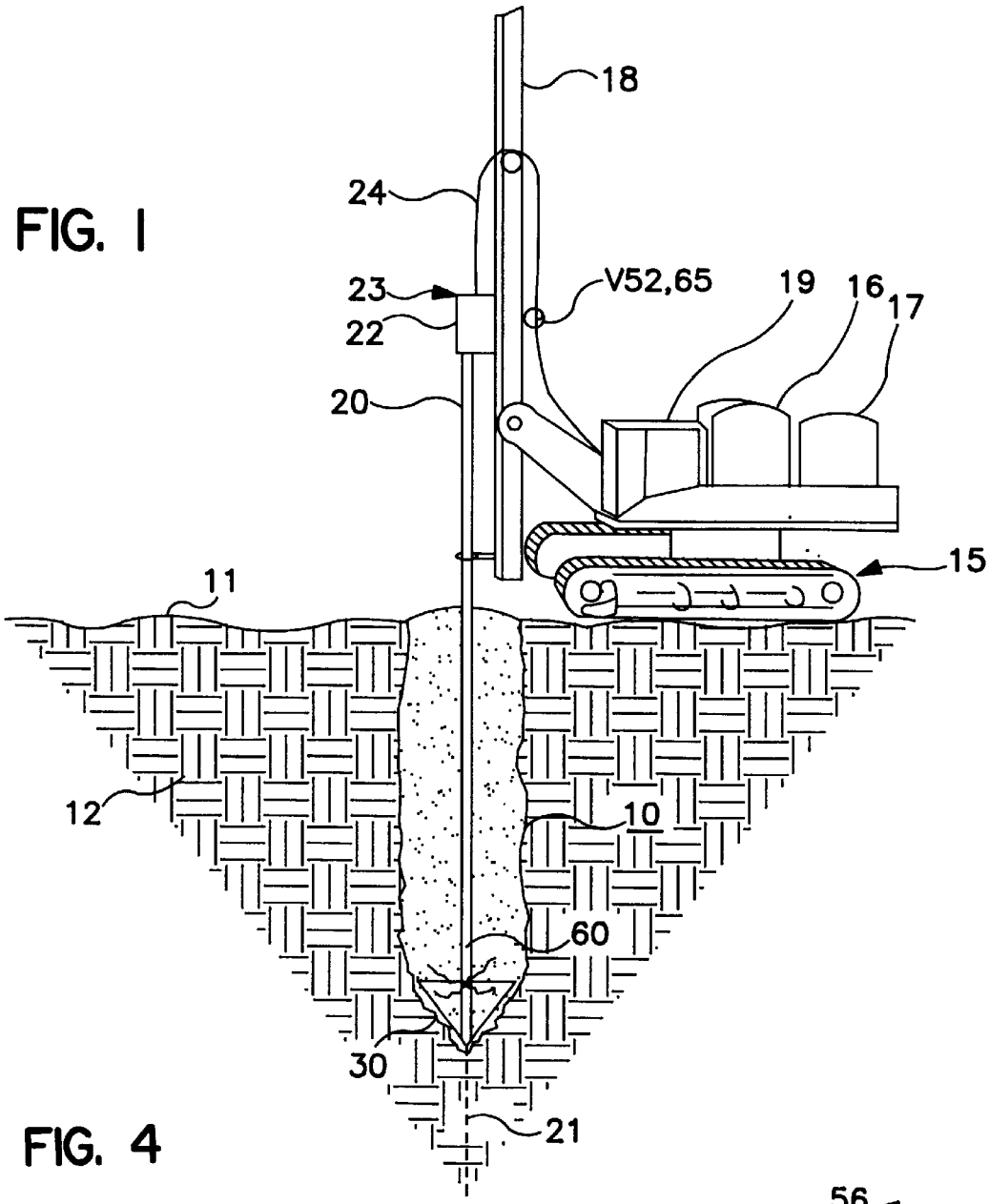
FIG. 1 is a semi-schematic drawing showing apparatus for accomplishing the process of this invention.

The purpose of this invention is to inject into the ground a suitable mixture of water, lime and cement so that, together with the soil and water already present, a column of cementitious material like a piling will be formed in-situ after the material has set up. As schematically shown in FIG. 1, a cylindrical bore 10 has been formed beneath surface 11 of ground 12. Although some rise of material will exist at the surface, there is no intended removal of soil.

A tractor-like vehicle 15 on the surface carries supplies 16, 17 of dry lime and dry cement, respectively. These supplies are under pressure so their contents may be pneumatically injected into the bore. A mast structure 18 supports a drive shaft 20 which has a central axis 21 along which it moves axially, and around which it can be rotated in both directions.

The vehicle also carries a supply 19 of water under pressure.

The frame 22 of a hydraulic motor 23 is slidably fixed to the mast. Its rotor (not shown) is connected to and turns shaft 20. A cable 24 suspends the motor, whose own weight is generally sufficient, along with the weight of the shaft, to drive the shaft into the ground while rotating. If desired, as will rarely be the case, power means (not shown) could also be supplied to add additional downward force. Usually the problem will be to regulate the penetration movement by exerting a restraining force on the cable.

At its lower end, shaft 20 carries an augur 30, or more properly an augur bit. It comprises a frame 3 which includes blades 32 and 33, both of which are joined at the tip end 36 of the augur. The tip end may carry a sharp piercing centering point 37. Rods 34 and 35 join the upper ends of the arms to the shaft. Notice that the frame is open. It is intended that only blades 32 and 33 react with the soil.

Figure 4:
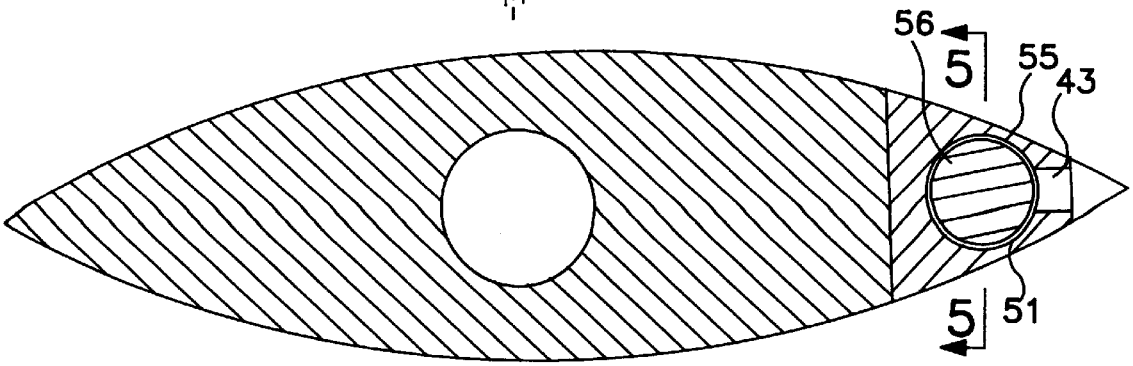
FIG. 4 is cross-section taken at line 4—4 in FIG. 3.
Figure 2:
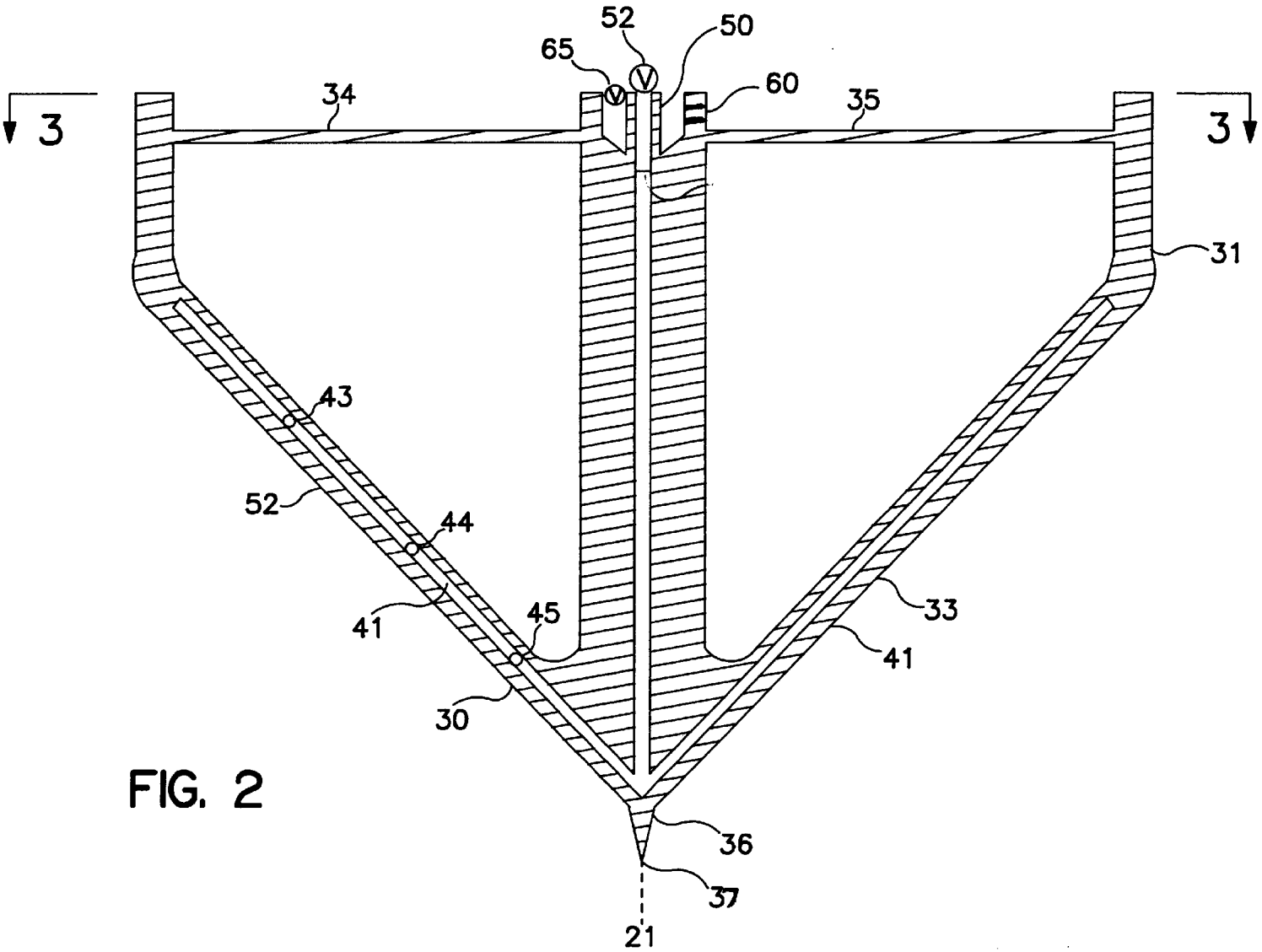
FIG. 2 is an axial cross-section of the augur.
Figure 3:
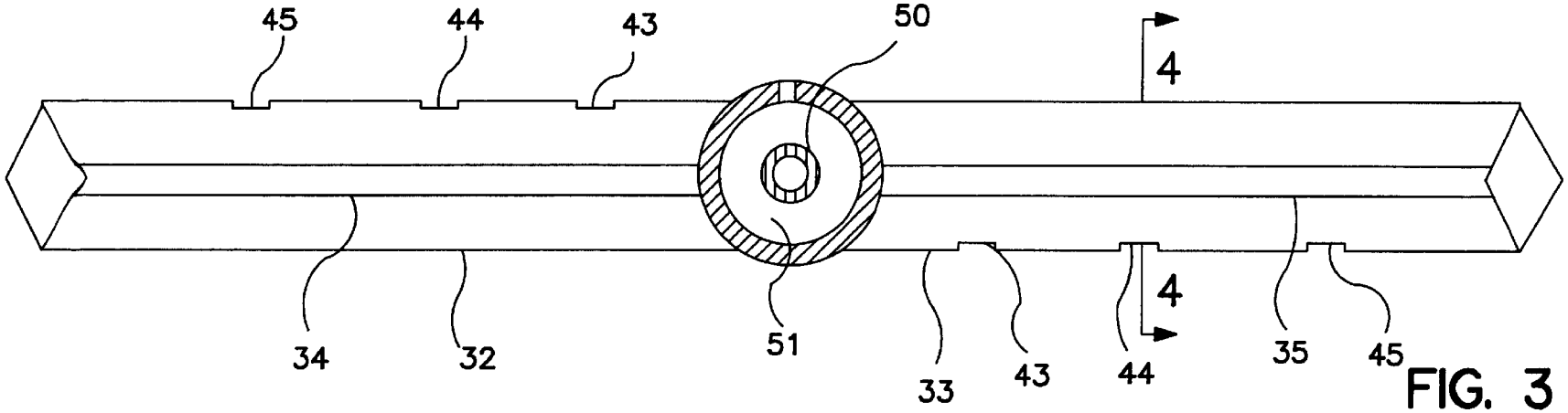
FIG. 3 is a cross-section taken at line 3—3 in FIG. 2.

As best shown in FIG. 4, arms 32 and 33 are best formed with vane-like outer walls to facilitate passage through the soil. They have an ovular shape for this purpose, which is slanted downwardly for penetration, and slanted upwardly for removal; that is, the shape is slanted relative to a plane normal to the axis of rotation.

Arms 32 and 33 are hollow, so as to provide water passages 41 to orifices 43, 44, 45 on they edge of each of the arms which is the leading edge when the augur is penetrating the ground. Orifices 43, 44, 45 are shown on blade 32. Similar orifices 46, 47, 48 are formed on blade 33. As few or as many of these orifices may be provided as the designer prefers. All passages 41 connect to water supply pipe 50 which extends coaxially through the tubular drive shaft, leaving a spacing 51 between them for a purpose to be disclosed. When the direction of rotation of the tool is reversed and the tool leaves the bore, these orifices will then be on the trailing edge.

There is a good reason for this location of the orifices. The augur must pass through regions of differing hardness. Near the surface, the soil will usually be harder and dryer. This is the region into which most water will be infected. Injection of the water ahead of the arm will soften and lubricate the soil, assisting the mixing of it, and will utilize the inherent properties of the water to facilitate the penetrating action.

A water control valve 52 in the water supply line controls the rate and amount of water being added. If desired, the valve can be programmed to supply the correct amount of water for each depth, but such accuracy will not often be necessary. Careful manual control will usually be sufficient. It is possible to instrument the valve so as to maintain a record of what in fact was injected.

Figure 5:
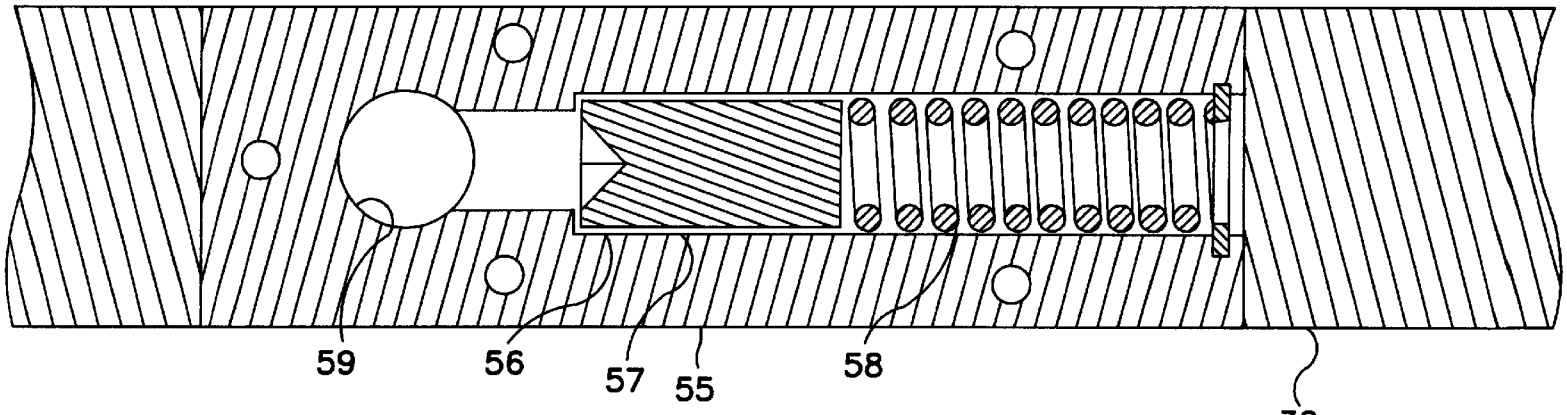
FIG. 5 is a cross-section taken at line 5—5 in FIG. 4.

These orifices must open to permit flow of water, and close to prevent soil from entering into the water system, where it might ultimately plug it. As best shown in FIG. 5, an orifice block 55 is fixed to the blade. It has an internal bore 56 in which a valve plunger 57 is slidably fitted. A bias spring 58 biases plunger 57 to the closed position shown in FIG. 5.

A supply port 59 connects via water supply passage 41 to the water supply pipe 50. When pressure is off in pipe 50, the spring will move the plunger to the illustrated closed position. When pressure is on, the plunger will be moved to expose the orifice, and water will jet out, ahead of the leading edge.

Orifices 60 are formed through the wall of the drive shaft, opening into the annular spacing 51 between the water line and the inside wall of the shaft. A mixture of dry lime and dry cement is fed to these orifices from supplies 16, 17. Generally these are injected from orifices 60 under a pneumatic pressure of about 4,000 psi. Under these circumstances, the dry materials will be infected throughout the stirred and moistened soil. In addition they will be thoroughly mixed in by the blades of the augur as it is withdrawn.

Valve means 65 controls pressure on the dry mixture to determine when it is to be injected into the soil. Typical rotary fluid couplings (not shown), connect the water supply line and the drive shaft to the sources of water, lime and cement.

The process of this invention is straight-forward. The amount of water to be added during insertion of the augur is predetermined, or determined while the augur is being inserted, and is added at the appropriate depth in the appropriate amount. Then, at the bottom of the bore no more water will be supplied. Then the augur is rotated (usually but not necessarily in the opposite direction), and the correct amount of lime and cement is injected. This mixture of water, soil, lime, and cement is stirred by the augur as it rises. This mixture then cures and the piling is complete.

The term "water" as used herein is not to be limited to water without additives. Adjuvants, accelerators, and non-aqueous liquids of various kinds may be added to this mixture if desired. Thus, the specification of water, soil, lime and cement is not intended to exclude other compounds and compositions which might be useful In the injection of the components, of their mixing, and of the setting of the total mixture.

This invention is not to be limited by the embodiments shown in the drawings and described in the description, which are given by way of example and not of limitation, but only in accordance with the scope of the appended claims.

I claim:

1. The process of forming an in-situ piling comprising existing soil, existing water, dry lime, dry cement, and injected water sufficient with said existing water to form a substantially stoichiometric mixture, said process comprising the following steps in the order recited;

a. driving a rotating augur into the soil from the surface of the soil to form a cylindrical bore of loosened soil;

b. during step a, adding water to said existing water already in the soil in an amount needed to form said stoichiometric mixture;

c. while rotating said augur, removing said rotating augur from the soil, while injecting dry lime and dry cement into said soil in amounts to form said stoichiometric mixture, said rotating augur mixing said soil, water, lime and cement; and d. permitting said mixture to cure.

2. The process according to claim 1 in which said added water is added according to a schedule reflective of existing water content at a plurality of depths.

3. The process according to claim 1 in which said added water is added at different rates at more than one depth, and the dry lime and dry cement are added at a constant rate.

* * * * *